US005711437A

United States Patent [19]

Flickinger

[11] Patent Number: 5,711,437

[45] Date of Patent: Jan. 27, 1998

[54] SWINGING FRAME CLOTHESLINE

[76] Inventor: Mark C. Flickinger, 1312 Canterbury La., Rockledge, Fla. 32955

[21] Appl. No.: 705,762

[22] Filed: Aug. 30, 1996

[51] Int. Cl.[6] ..... A47F 7/00

[52] U.S. Cl. ..... 211/119.01

[58] Field of Search ..... 211/104, 99, 119.01

[56] References Cited

U.S. PATENT DOCUMENTS

| | | | |
|---|---|---|---|
| 524,869 | 8/1894 | Sheets | 211/99 |
| 1,021,654 | 3/1912 | Boschee . | |
| 1,260,163 | 3/1918 | Downie . | |
| 1,551,468 | 8/1925 | Chapman | 211/99 |
| 1,962,205 | 6/1934 | Murray | 211/99 X |
| 2,295,736 | 9/1942 | Jernson | 211/104 |
| 2,433,275 | 12/1947 | Higby, Sr. | 211/104 |
| 2,483,792 | 10/1949 | Cate | 211/169 |
| 2,530,632 | 11/1950 | Scherstuhl | 211/104 |
| 2,736,438 | 2/1956 | Frey | 211/104 |
| 2,808,065 | 10/1957 | Ellis | 135/5 |
| 2,889,052 | 6/1959 | O'Neill | 211/104 |
| 2,950,822 | 8/1960 | Cope . | |
| 3,025,866 | 3/1962 | Cockrum | 135/5 |
| 4,600,109 | 7/1986 | Schulz | 211/99 X |
| 4,739,888 | 4/1988 | Steiner | 211/119.01 X |
| 4,991,724 | 2/1991 | Wei | 211/99 X |
| 5,193,695 | 3/1993 | Mann | 211/104 |
| 5,372,266 | 12/1994 | Fisher | 211/119.01 X |

FOREIGN PATENT DOCUMENTS

| | | | |
|---|---|---|---|
| 2634795 | 2/1990 | France | 211/119.01 |
| 561809 | 10/1932 | Germany . | |

*Primary Examiner*—Leslie A. Braun
*Assistant Examiner*—Sarah L. Purol
*Attorney, Agent, or Firm*—Edward M. Livingston, Esq.

[57] ABSTRACT

A swinging-frame clothesline having a frame (1) sized, shaped and structured to support clotheslines (2) between opposite sides (3, 4, 5, 6) of the frame. The frame has an attachment side (3) that is attached pivotally to a fence (8) and a support side (4) that hangs down vertically when not being used. The frame is supportable with support legs (15) that pivot vertically to a selectively upright attitude under the frame to position the frame in a selectively horizontal attitude for use mode. The support legs are pivotal to an attitude selectively parallel to the frame to allow the frame to pivot vertically downward to a non-use mode. Support braces (16) can be suspended between opposite sides of the frame to which clotheslines are attached.

13 Claims, 4 Drawing Sheets

SWINGING FRAME CLOTHESLINE

BACKGROUND OF THE INVENTION

This invention relates to clotheslines and in particular to swinging, convertible, foldable and collapsible clotheslines.

Outdoor clothes-drying is a method of choice for many people, even though they have the best of clothes driers. They like its sun-drenched freshness and cleanliness. More sanitary than clothes driers, outdoor drying also gives body to clothing, makes it look better and gives it longer use life.

Current building codes often prohibit permanent clotheslines. This is understandable and plausible. It reflects popular aesthetics. Most people who like outdoor drying also don't like the cluttered appearance of permanent clotheslines. They want neat outdoor drying that is not visible from outside of their yards or from their own luxury living areas. They want it secluded, out of sight when not being used and yet convenient and simple. That is the purpose of this invention. Prohibiting this is unreasonable and likely unconstitutional restriction on use of private property. Objectionable aspects of sun-drying clothes have been removed to allow its desirable advantages to be savored.

Known swinging, convertible, foldable and/or collapsible clotheslines have provided various forms of assembly for part-time use and disassembly for storage, but not in a seclusive and convenient manner taught by this invention. For example, U.S. Pat. No. 5,193,695, issued to Mann, was limited to a locking hinge device for pivotal support of a frame member such as a clothesline frame. U.S. Pat. No. 3,025,866, issued to Cockrum, taught a fabric stretcher on a pivotal frame that was limited to construction with stretching devices. U.S. Pat. No. 2,889,052, issued to O'Neill, taught telescopic arms for positioning a clothesline beneath a window. U.S. Pat. No. 2,736,438, issued to Frey, described an I-frame with a center pole that was suspended from a line on a pulley. U.S. Pat. No. 2,483,792, issued to Ten Cate, taught a diaper drier with a hinged frame with clothes pins. German Patent No. 561,809, issued to Kirrstetter, described a permanent clothesline frame that was braced from the top on a wall. U.S. Pat. No. 1,260,163, issued to Downie, taught a vertical clothes rack attached pivotally to a wall. U.S. Pat. No. 1,021,654, issued to Boschee, taught a clothes rack on a pole with sides that were pivotal from a vertical position to a horizontal attitude.

SUMMARY OF THE INVENTION

In light of need for improvement of clothesline to allow advantages of their use within requirements of legal building codes and public appeal, objects of this invention are to provide a swinging-frame clothesline which:

can not be seen from outside of a fenced yard whether or not having clothes hanging from it;

is quick and convenient to set up for use and to let down or taken down for storage when not in use;

meets requirements of building codes that prohibit permanent clotheslines; and is inexpensive, easy to install and long lasting.

This invention accomplishes these and other objectives with a swinging-frame clothesline having a frame sized, shaped and structured to support clotheslines between opposite sides of the frame. The frame has an attachment side that is attached pivotally to a fence or wall and a support side that hangs down vertically when not being used. The frame is supportable with support legs that pivot vertically to a selectively upright attitude under the frame to position the frame in a selectively horizontal attitude for use mode. The support legs are pivotal to an attitude selectively parallel to the frame to allow the frame to pivot vertically downward to a non-use mode. Brace rods can be suspended between opposite sides of the frame. Clotheslines, support legs and brace rods can be suspended between either two opposite sides of the frame.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
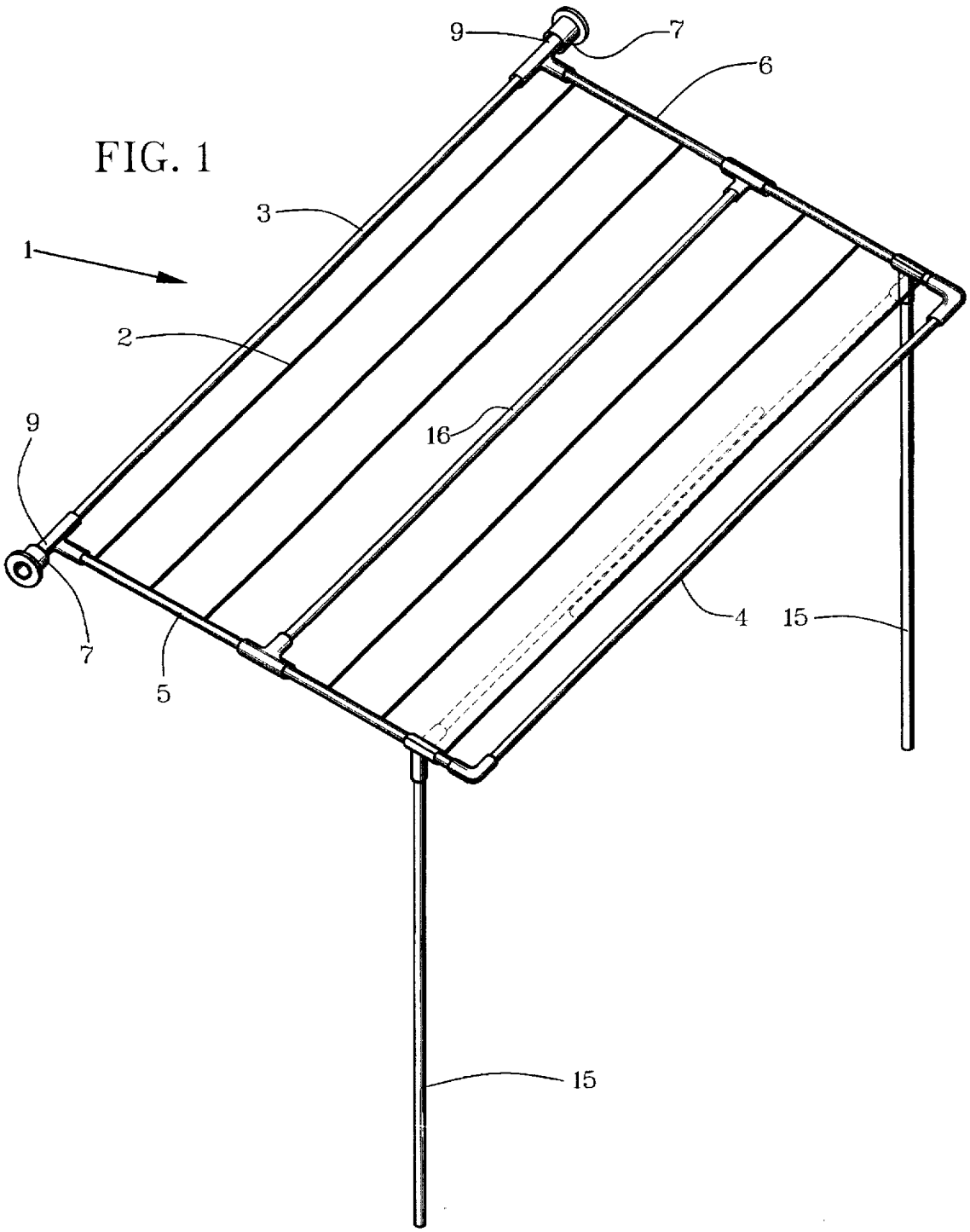
FIG. 1 is a perspective view of a swinging-frame clothesline in use mode.

In the drawings, reference is made first to FIGS. 1–7. A frame 1 is sized, shaped and structured to support clotheslines 2. The frame 1 has an attachment side 3, a support side 4, a first frame side 5 and a second frame side 6.

Figure 2:
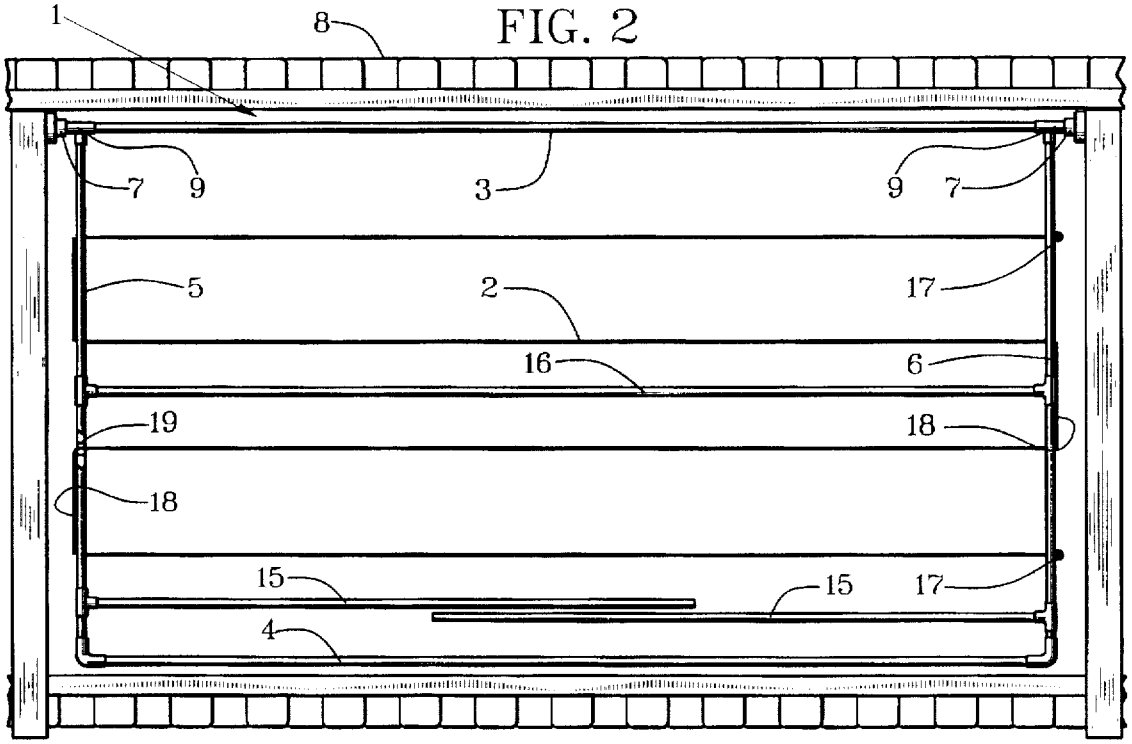
FIG. 2 is a front view of a swinging-frame clothesline hanging on a fence in non-use mode.
Figure 3:
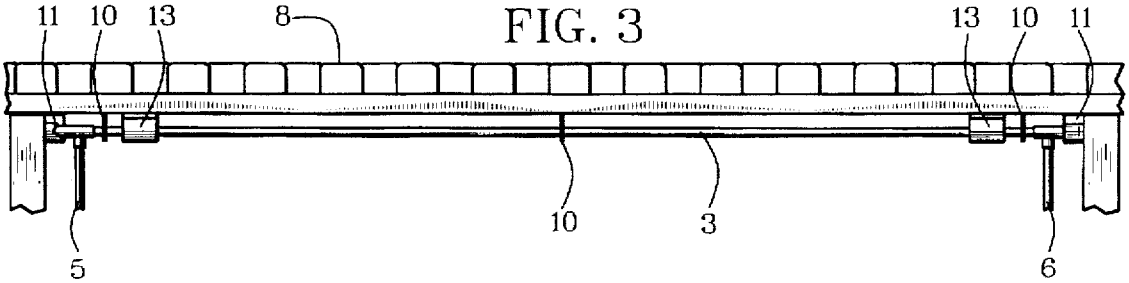
FIG. 3 is a fragmentary view of a top portion showing a selection of pivotal attachments to a wall such as a fence or building.
Figure 4:
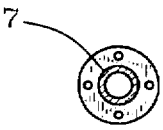
FIG. 4 is a front view of an axle housing as a pivotal attachment depicted in FIGS. 1–2.

On the attachment side 3 is one or more of a selection of pivotal attachments. A pivotal attachment depicted in FIGS. 1–2 is a pair of axle housings 7 that are attachable to facing sides of a structure such as sides of fence posts of a privacy fence 8. A matching pair of axle projections 9 on outsides of the frame 1 are positioned in rotational contact with inside peripheries of the axle housings 7.

The frame 1 can be constructed of a selection of materials such as plastic pipe. Use of plastic pipe allows corners of the frame 1 to be pipe elbows. It also allows use of pipe T-joints to be used for the axle projections 9. Further, pipe construction of frame 1 provides circular portions, such as cylindrical outside peripheries, that are positional in rotational contact with inside peripheries of a selection of axle housings. Rectangular or flat-edged structural members would require special construction of rounded or circular portions for use with cylindrical bearing surfaces. High grades of plastic pipe are preferred construction materials for long use life, lightness, ease of construction and structural integrity.

Figure 5:
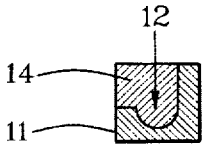
FIG. 5 is a side view of a J-hook bearing as an optional pivotal attachment.
Figure 6:
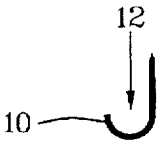
FIG. 6 is a side view of a J-hook rod as an optional pivotal attachment.
Figure 7:
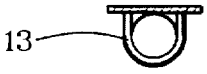
FIG. 7 is a side view of a U-housing as an optional pivotal attachment.

Optional pivotal attachments include at least two in-line J-hook rods 10 or J-hook bearings 11 attachable to a structure with axes of hook bays 12 in a common plane. Various types of U-bearings 13 also can be employed. Pictured together in FIG. 3 for demonstrating separate use of each are J-hook rods 10, J-hook bearings 11 and U-bearings 13. J-hook bearings 11 can have J-hook walls 14 as shown in FIG. 5 for attachment to facing sides of a structure if desired for particular use conditions. J-hook bearings 11 without J-hook walls 14 are depicted proximate facing sides of a structure in FIG. 3 and separately from facing sides of a structure in FIG. 9. J-hook rods 10 are shown from a side of a hook bay 12 in FIG. 6 and from a front of a hook bay 12 in FIGS. 3 and 8.

Advantages of J-hook rods 10 and J-hook bearings 11 include being able to put up the frame 1 quickly and easily for use and then being able to take it down and put it away just as quickly and easily when not being used. Short people such as some children and some ladies also can maneuver the attachment side 3 into the hook bays 12 from a low position.

At least one support leg 15 is attached pivotally to at least one side of the frame 1 at a position designedly proximate the support side 4. Preferably one support leg 15 is attached pivotally to the first frame side 5 and a separate support leg 15 is attached pivotally to the second frame side 6. This allows the support legs 15 to be pivoted inwardly to parallelism as indicated by dashed lines in FIG. 1 and by solid lines in FIG. 2 to position the frame 1 in a vertical non-use mode for hanging or for being taken down when not in use. This embodiment is particularly suitable for some sizes of frames 1.

Support braces 16 can be extended between opposite frame sides 5 and 6 or 3 and 4 to which clotheslines 2 are attached. This prevents inward bowing of the frame sides 5 and 6 or 3 and 4 from weight of clothing on the clotheslines 2.

Figure 8:
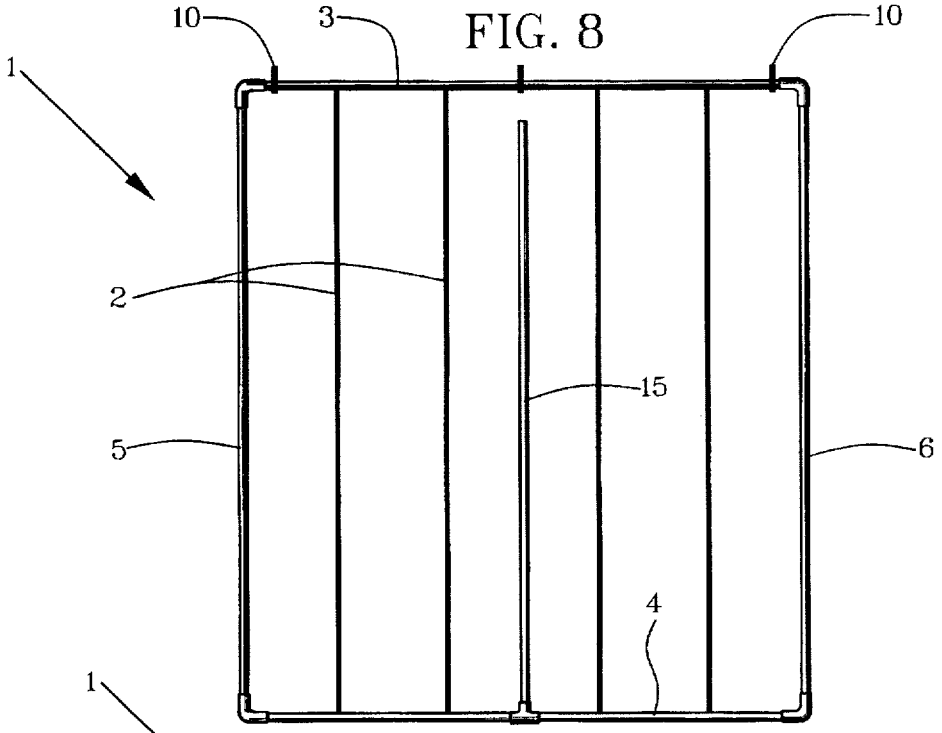
FIG. 8 is a front view of an embodiment having a single support leg that is attached pivotally to a support side and having clotheslines suspended perpendicularly to the attachment side.
Figure 9:
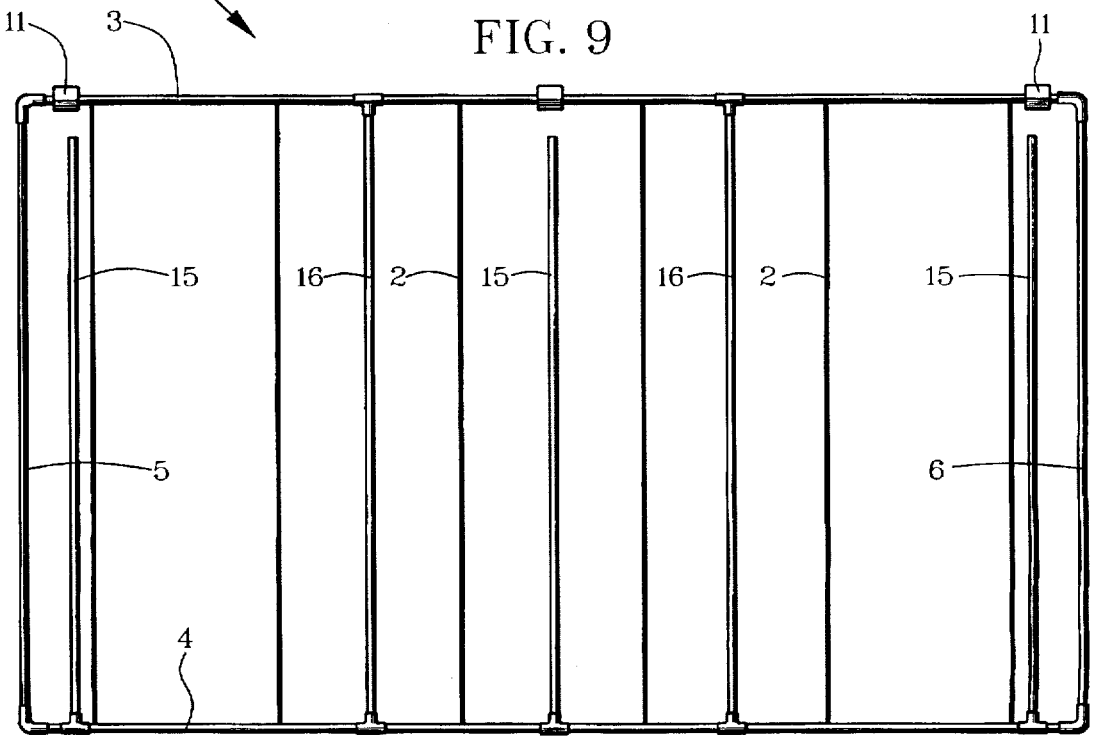
FIG. 9 is a front view of an embodiment having a plurality of support legs that are attached pivotally to a support side and having clothesline suspended perpendicularly to the attachment side.

Referring to FIGS. 8–9, clotheslines 2 can be suspended between the attachment side 3 and the support side 4 for particularly narrow frames 1 as depicted in FIG. 8 or for particularly wide frames 1 as depicted in FIG. 9. Narrow frames 1 may be narrow enough not to require support braces 16 as illustrated in FIG. 8 or wide enough to require an appropriate plurality of support braces 16 as illustrated in FIG. 9.

A selection of sizes and shapes of frames 1 are provided for different preferences and use conditions. Some will be for small areas, possibly small people and possibly one or few users. Larger sizes are for larger areas and greater use. Height of attachment to particular structures can be matched with sizes of frames 1 and lengths of support legs 15.

A single clothesline 2 can be woven from-side-to-side as shown in FIG. 2 with a knot 17 on opposite ends and end sections 18 between frame orifices 19. Woven attachment between either sides 5 and 6 or 3 and 4, however, subjects the clothesline 2 to effects of different weights of clothing on different sections of suspension. Unless attachment between frame orifices or other line-attachment means is rigid, weight of clothing on the different sections of suspension requires balancing to prevent sagging by heavier clothing in one or more sections of suspension. The clotheslines 2 are illustrated without reference to line-attachment means in FIGS. 1 and 8–9 in order not to suggest limitation to a particular type attachment.

Figure 10:
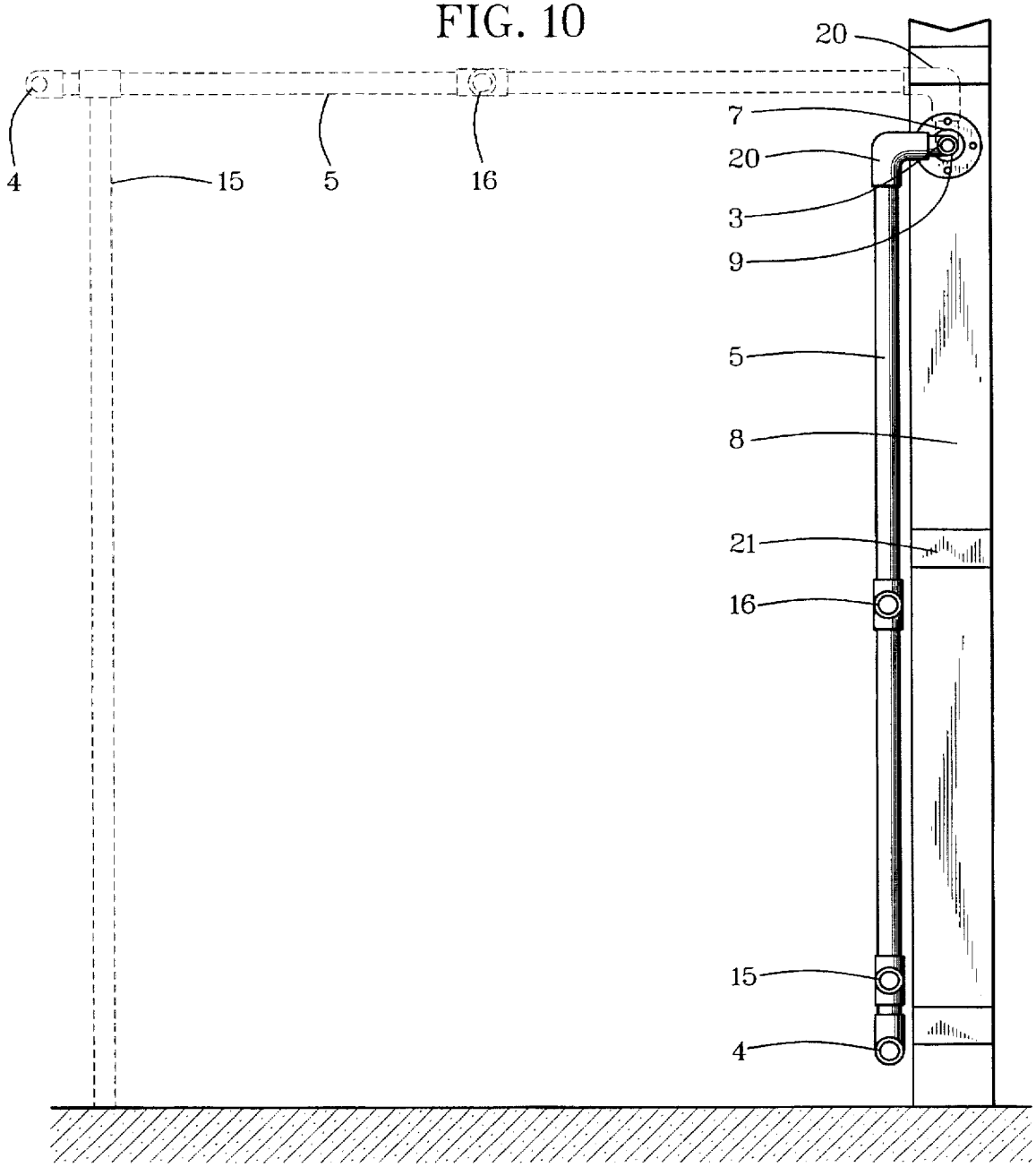
FIG. 10 is an end view of a section of an embodiment having an angle or elbow extension to position the frame and lines away from cross members of structures such as pool fences when hanging down.
Figure 11:
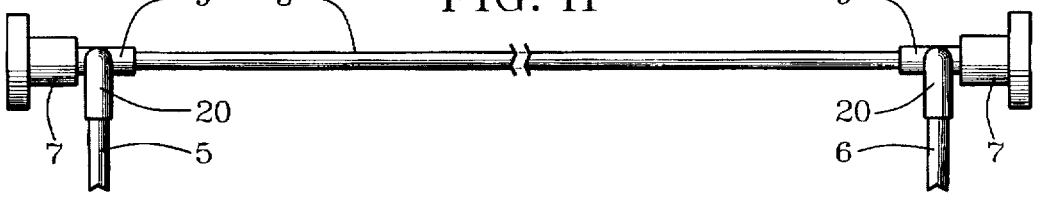
FIG. 11 is a fragmentary front elevational view of an attachment section of the FIG. 10 embodiment.

Referring to FIGS. 10–11, an extension elbow 20 can be provided to position the frame 1 away from cross members 21 in some types of structures when hanging down. This is a recess mounting that is particularly significant for enclosures of swimming pools which have cross members 21 on screen frames, but is applicable also to some types of privacy fences 8 and other structures.

A new and useful hanging-frame clothesline having been described, all such modifications, adaptations, substitutions of equivalents, mathematical possibilities of combinations of parts, pluralities of parts, applications and forms thereof as described by the following claims are included in this invention.

Having thus described my invention, I claim:

1. A swinging-frame clothesline comprising:

a frame that is sized, shaped and structured to support clotheslines between opposite sides of the frame;

the frame having an attachment side, a support side, a first frame side and a second frame side;

at least one pivotal attachment on the attachment side of the frame;

at least one support leg attached pivotally to at least one side of the frame proximate the support side of the frame;

at least one support leg being pivotal to a selectively upright attitude under the frame with the frame in a selectively horizontal attitude for use mode; and at least one support leg being pivotal to an attitude selectively parallel to the frame with the frame in a selectively vertical attitude for non-use mode, wherein the at-least-one pivotal attachment on the attachment side of the frame has a pair of axle housings that are attachable to facing sides of a structure;

the attachment side of the frame has a matching pair of axle projections on outside edges of the frame; and the matching pair of axle projections are positioned in rotational contact with inside peripheries of the axle housings.

2. A swinging-frame clothesline as described in claim 1 wherein:

the frame is constructed of pipes of suitable materials; and the pair of axle projections are extensions of T-joints proximate opposite corners of the frame.

3. A swinging-frame clothesline as described in claim 1 wherein:

the frame is constructed of pipes of suitable materials.

4. A swinging-frame clothesline as described in claim 1 wherein:

the at least one support leg is a first support leg and a second support leg;

the first support leg has a leg-attachment end that is pivotal on the first frame side;

the second support leg has a leg-attachment end that is pivotal on the second frame side; and the first support leg and the second support leg have lengths that are proximate a distance of height of attachment of the attachment side on a structure.

5. A swinging-frame clothesline as described in claim 4 wherein:

clotheslines are extended between the first frame side and the second frame side.

6. A swinging-frame clothesline as described in claim 5 wherein:

at least one support brace is extended between the first frame side and the second frame side.

7. A swinging-frame clothesline as described in claim 1 wherein:

the at least one support leg is at least a first support leg and a second support leg;

the first support leg has a leg-attachment end that is pivotal on the support side proximate the first frame side;

the second support leg has a leg-attachment end that is pivotal on the support side proximate the second frame side; and the first support leg and the second support leg have lengths that are proximate a distance of height of attachment of the attachment side on a structure.

8. A swinging-frame clothesline as described in claim 7 wherein:

clotheslines are extended between the support side and the attachment side of the frame.

9. A swinging-frame clothesline as described in claim 8 wherein:

at least one support brace is extended between the support side and the attachment side of the frame.

10. A swinging-frame clothesline as described in claim 1 wherein:

the support leg has a leg-attachment end that is pivotal on the support side proximate a position midway between the first frame side and the second frame side; and the support leg has a length that is proximate a distance of height of attachment of the attachment side on a structure.

11. A swinging-frame clothesline as described in claim 10 wherein:

clotheslines are extended between the support side and the attachment side of the frame.

12. A swinging-frame clothesline as described in claim 1 and further comprising:

at least one support brace extended intermediate opposite sides of the frame to which clotheslines are attached.

13. A swinging-frame clothesline as described in claim 1 and further comprising:

angular extensions intermediate frame sides and axle projections to position the frame and clotheslines away from cross members and wall portions of structures when hanging down in non-use mode.

* * * * *